US005935499A

United States Patent [19]

Hughes et al.

[11] Patent Number: 5,935,499

[45] Date of Patent: Aug. 10, 1999

[54] METHOD AND APPARATUS OF TRANSFERRING A PACKET AND GENERATING AN ERROR DETECTION CODE THEREFOR

[75] Inventors: O. Richard Hughes, Chatham; Dieter K. Kurschus, Bayville; John A. Flint, Berkeley Heights; Cheng K. Saw, Summit, all of N.J.

[73] Assignee: HNA Holdings, Inc., Charlotte, N.C.

[21] Appl. No.: 08/987,883

[22] Filed: Dec. 8, 1997

[51] Int. Cl.[6] ..... D01D 5/12

[52] U.S. Cl. ..... 264/210.8; 528/502; 528/503; 264/176.1; 264/177.13; 264/177.17; 264/177.19; 264/210.1; 264/210.5; 264/280; 264/291

[58] Field of Search ..... 528/502, 503; 264/176.1, 177.13, 177.17, 177.19, 210.1, 210.8, 210.5, 280, 291

[56] References Cited

U.S. PATENT DOCUMENTS

| | | | |
|---|---|---|---|
| 4,101,525 | 7/1978 | Davis et al. | 528/309 |
| 4,195,052 | 3/1980 | Davis et al. | 264/210 |

*Primary Examiner*—Samuel A. Acquah

*Attorney, Agent, or Firm*—Gregory N. Clements; Walter M. Douglas

[57] ABSTRACT

Fibers and yarns of polyethylene terephthalate (PET) and PET copolymers with a sheath/filamentous core microstructure are formed from unoriented and non crystalline "as spun" source fibers and yarns by drawing to high draw ratios in one step. Fibers and yarns with the sheath/filamentous core microstructure are stiffer than commercial PET fibers. Fibers and yarns with the sheath/filamentous core microstructure may be annealed and relaxed to increase their dimensional stability without loss of the sheath/filamentous core microstructure.

18 Claims, 2 Drawing Sheets

METHOD AND APPARATUS OF TRANSFERRING A PACKET AND GENERATING AN ERROR DETECTION CODE THEREFOR

BACKGROUND AND SUMMARY OF THE INVENTION

This invention relates to a process for producing fibers and yarns of polyethylene terephthalate (PET) and PET copolymers which have a unique morphology. Unoriented and non-crystalline PET yarn, when drawn in accordance with the process of the invention, is formed into a yarn in which each fiber of the yarn has a sheath/fibrillar core (s/fc) microstructure. Because of this unique microstructure the yarn exhibits unique physical properties.

PET fibers and yarns are known and utilized in many industrial applications. Industrial PET fiber and yarns, are differentiated from other PET filaments by their higher tenacity (strength) and higher modulus (stiffness). These high strength polymer fibers are particularly suitable for such applications as tire cords, conveyor belts, hosing, threads, carpets and the like. However, in the past, high stiffness PET fibers have suffered from substantial shrinkage when subjected to heat, which may render them unusable for many applications for which they are otherwise well suited, such as for tire cords. In order to reduce heat shrinkage while retaining high stiffness U.S. Pat. Nos. 4,101,525 and 4,195,052 are directed to processes for producing PET fibers which have high stiffness and reduced shrinkage and greater dimensional stability. These improved tensile properties result from the high degree of polymer extension and alignment along the fiber axis and by the distribution of fine, uniformly distributed, oriented, stabilizing crystallinity in the filaments that is produced in the spinning a drawing process. PET yarns produced in accordance with these processes are known as High Modulus Low Shrinkage (HMLS) yarns and have received commercial acceptance. Nevertheless, the art desires fibers and yarns of even greater tenacity and modulus, reduced heat shrinkage, and greater dimensional stability. The present invention is directed towards providing such improved PET fibers and yarns.

The starting fiber used for carrying out the present invention is molecularly unoriented and non-crystalline PET fiber or yarn. When drawn according to the invention such that a draw ratio of greater than 5.7:1 is achieved in one step then each fiber in such a drawn yarn will have a sheath/fibrillar core (s/fc) distribution of microstructure that is visible in optical photomicrographs of the fiber. By this is meant that the core of each fiber has a multitude of long crystalline fibrils with a diameter of about 0.1 um that are aligned with the fiber axis. The polymer in the sheath of each fiber does not have long fibrils but is comprised of oriented and crystalline PET.

PET fibers having the s/fc morphology exhibit a higher modulus than that of HMLS PET fibers and yarns, but exhibit higher heat shrinkage when heat-treated. In order to reduce the degree of shrinkage on heating in fibers with the s/fc microstructure, the fibers may be subjected to additional processing. These additional processing steps are 1) Annealing (heat treating under high line tension to further develop crystallinity) and 2) Relaxing (heat treating under reduced line tension to allow a degree of shrinkage). The s/fc microstructure is retained throughout the annealing and relaxation steps.

PET fibers and yarns that have a s/fc microstructure and which have been annealed and relaxed have higher stiffness, lower heat shrinkage, and higher dimensional stability than that of the commercially available HMLS fibers and yarns. Accordingly PET yarns and fibers processed in accordance with the present invention are higher performance substitutes for the applications for which HMLS yarns and fibers are suited.

BRIEF DESCRIPTION OF THE DRAWINGS

For a better understanding of the invention, reference is made to the following drawings which are to be taken in conjunction with the detailed description to follow in which.

DESCRIPTION OF THE PREFERRED EMBODIMENTS

Figure 1:
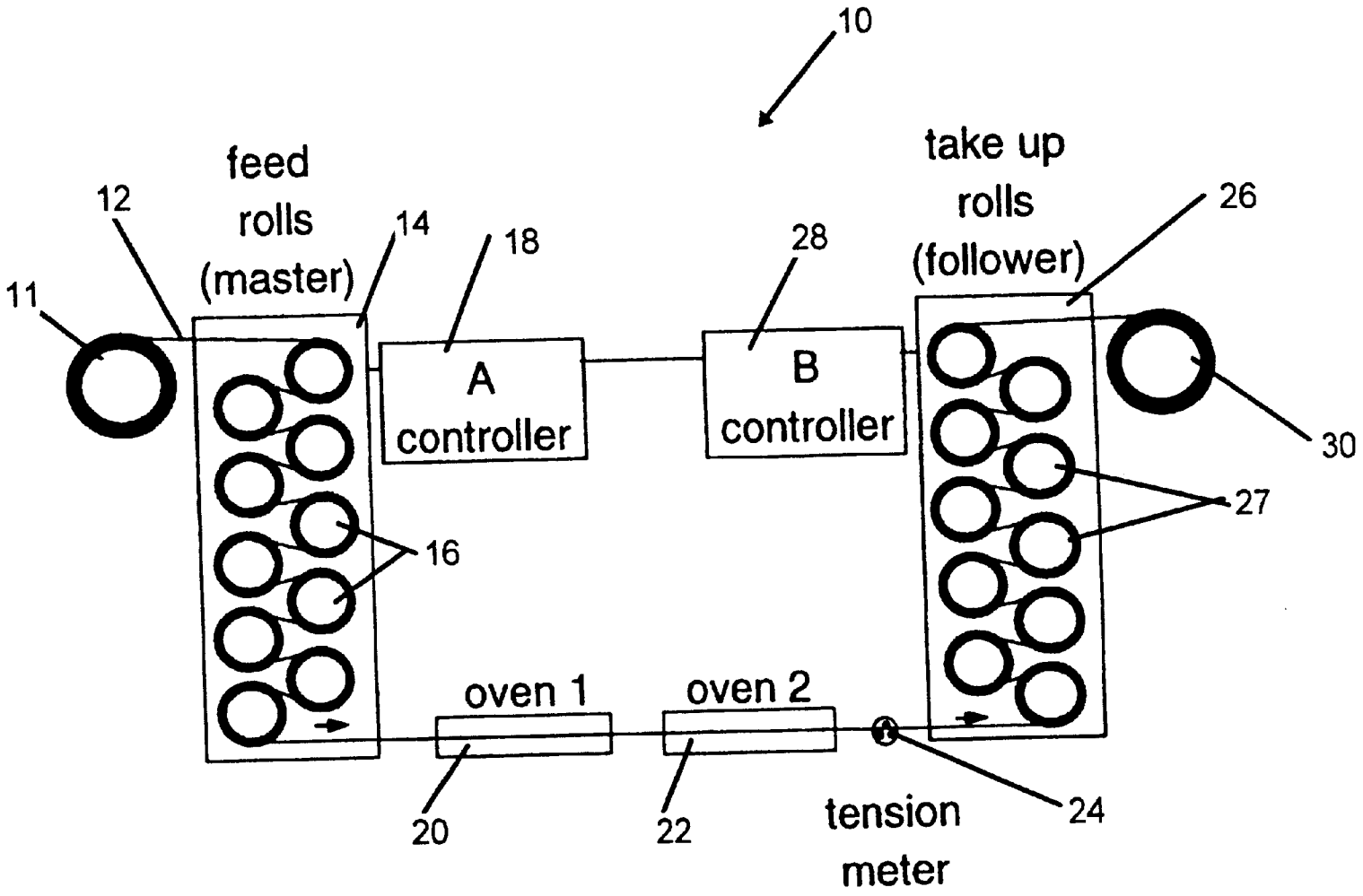
FIG. 1 is a schematic representation of the equipment for carrying out the drawing and relaxing steps of the present invention.

In order to achieve a PET yarn or fiber having the desired s/fc microstructure and physical characteristics it is necessary that the feed PET fiber or yarn be molecularly unoriented and non-crystalline. The presence of either orientation or crystallinity will prevent the formation of the s/fc microstructure in the drawing process. Fibers that are unoriented and non-crystalline have low birefringence, so that a birefringence test may be used to determine if a fiber is suitable for use in this process. Generally speaking unoriented and non-crystalline PET fibers result when the fibers are spun at low speed, that is spinning speeds in the area of 1–300 mpm (meters per minute). Fibers spun at higher rates (1000 mpm) will be partially aligned and those spun at even higher rates (>2000 mpm) will be highly aligned and partially crystalline. Either of these conditions will not allow the desired s/fc microstructure to be formed.

FIG. 1 illustrates drawing apparatus 10 suitable for carrying out the various drawing (and relaxing) steps of the present invention. A supply spool 11 provides the fiber or yarn 12 to be worked to a feed unit 14 which comprises a number of driven wheels 16 through which the fiber 12 is threaded so that the feeding speed of fiber 12 is controlled by the rotation of wheels 16 whose speed is controlled by controller 18. After exiting feed unit 14, fiber 12 passes through temperature controlled ovens 20,22 which act to provide any necessary heating to fiber 12. A tension meter 24 senses the tension of fiber 12 and supplies a signal indicating the tension of fiber 12 to permit the process to be controlled. Fiber 12 then passes to take up unit 26 and is threaded through a series of driven take up wheels 27 under the control of controller 28 and passes to a take up spool 30.

The speed of rotation of wheels 16 of feed unit 14 is controlled by controller 18 which cooperates with controller 28 to control the speed of wheels 27 of take up unit 26. When wheels 27 of take up unit 26 are rotated at a speed greater than that of wheels 16 of feed unit 14 a tension will be applied to fiber 12 so that it can be drawn. Conversely, when wheels 27 of take up unit 26 are rotated at a speed lesser than that of wheels 16 of feed unit 14 a relaxation will be applied to fiber 12. Ovens 20,22 are used to supply any heating to fiber necessary to the drawing or relaxing steps. The ratio of speed of rotation of the wheels 27 of take up unit 26 to the speed of the wheels 16 of feed unit 14 controls the "draw ratio" applied to fiber 12. By way of example, if take up unit 26 is operated at a speed 6 times that of feed unit 14 the draw ratio will be 6 to 1, so that the length of fiber 12 will be increased to approximately six times its original length in this drawing process. For processes requiring multiple drawing (or relaxing) steps a series of feeding and take up units, ovens and their associated controllers may be used to complete the steps of the process in a continuous manner.

The s/fc microstructure of the fibers and yarns processed in accordance with the present invention is formed by drawing unoriented, non-crystalline PET yarns to draw ratios beyond 5.7 to 1 in one step at temperatures just above or below the polymer glass transition temperature, Tg (approximately 80° C.). To achieve high draw ratios (>5.7:1) in one step high, near breaking, tensions must be applied to the draw line. When such tensions are applied a so-called "head and shoulders neck" forms in the yarn at a point between the feed rolls and the oven. A "head and shoulders" neck is characterized by an abrupt transition to narrower diameter. In this type of necking the diameter of the fiber undergoes an abrupt reduction in diameter in the space of less than a few millimeters. (This is not the same as the thinning or extension that occurs in many polymer drawing processes where the draw in any one step is at less than 5.7 to 1 or at draw temperatures well above Tg. (In a thinning, the diameter of the drawn fibers gradually reduces over a space of one or more centimeters.) Heat and draw line tension are needed to initiate the head and shoulders necking of the fibers but it is usually possible to maintain the neck at lower temperatures with higher applied tensions. Necking initiation temperatures in the range 60 to 120° C. have been used. Maintenance temperatures as low as 29° C. are possible.

In order to assure the formation of the desired s/fc microstructure it is necessary to draw the unoriented non-crystalline yarn with a sufficiently high line tension so that: a) a head and shoulders neck forms and b) a high draw ratio (5.7 to 1 or greater) results in a single step. The equipment illustrated in FIG. 1 is useable to carry out this drawing. In order to draw to a ratio of 5.7 or greater to one the rotation of speed of the take up unit 26 is adjusted by controller 28 so that its wheels 27 rotate at a speed 5.7 or more times the speed of wheels 16 of feed unit 1. Drawing of the fibers or yarns at much above 6 to 1 may cause breakage of the fiber or yarn, thus such breaking draw ratios form the upper limit of the draw ratio of this process. Ovens 20 (or 22) are used to apply heat to the fiber to cause initiation of the head and shoulders neck, after neck initiation the temperature of the ovens 20,22 may be reduced, as less temperature is required to maintain the neck. Generally speaking in order to produce the s/fc microstructure draw throughput rates between 2 and 6 mpm are required.

Figure 2A:
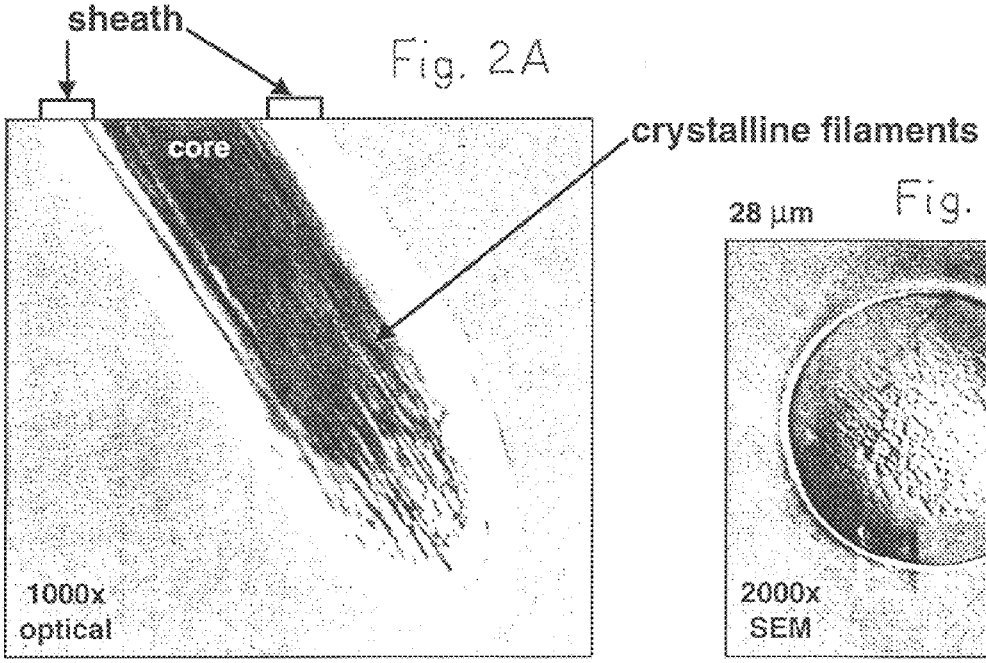
FIG. 2*a* is a optical photomicrograph of a fiber which has been cut along a diagonal so as to show the sheath/fibrillar core thereof.
Figure 2B:
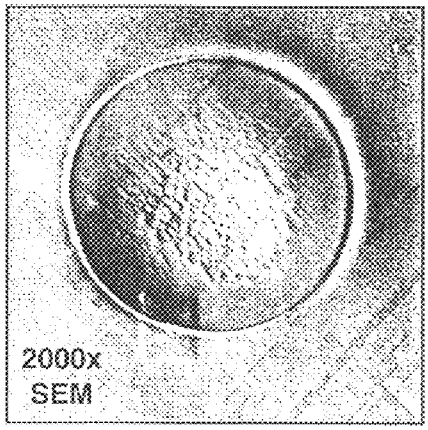
FIG. 2*b* is a SEM photomicrograph of the s/fc fiber showing the cross section.

Each fiber in such a drawn yarn has a s/fc distribution of microstructure that is visible in optical micrographs of the fiber at 1000× magnification. FIG. 2*a* and 2*b* are respectively an optical and a SEM photomicrograph of a fiber processed according to the present invention, which clearly shows the s/fc microstructure. Typically the fibrillar core is contained in the central 17 um of a 28 um diameter fiber. The sheath of each fiber is highly oriented (as shown by birefringence) and crystalline (as shown by the absence of a "cold crystallization" peak in DSC thermograms) but free of the fibrillar filaments which are seen in the core. The core of each fiber includes a multitude of long crystalline microfibrils (as seen in optical micrographs at 1000× magnification) that are aligned with the fiber axis and have a diameter of about 0.1 um. Typically approximately 700 microfibers can be counted in the core of a 28 um diameter fiber. It appears that the strain caused by drawing to high ratios induces a type of strain-induced crystallization that results in the s/fc microstructure.

As will be discussed in detail below, a fiber or yarn of PET with the s/fc microstructure will have a high stiffness (initial modulus or EASL). However, the dimensional stability of the "as drawn" yarn can be improved by processing that improves the crystallinity (annealing) and reduces its heat shrinkage (relaxation). Annealing and relaxing lead to yarns with a s/fc microstructure which exhibit an improved dimensional stability.

In the annealing step fiber that has been drawn to induce the s/fc microstructure is subjected to a higher temperature heat treatment under high, near breaking, line tensions to improve the crystal structure. The annealing is conducted at a temperature above the cold crystalline temperature (approximately 140° C.) of PET as determined from DSC thermograms. This is believed to result in a growth in crystal size and perfection. Annealing is conducted at high, near breaking, line tensions so as to prevent any contraction of extended polymer chains. By way of example, a drawn PET yarn with a s/fc microstructure can be annealed by subjecting it to line tension that produces a slight additional draw (draw ratios of 1.05–1.3 to 1) at a temperature of 200° C. for a residence time of 30 seconds. Annealing produces an increase in yarn stiffness and a reduction in heat shrinkage while retaining the sheath/core microstructure.

If a greater reduction in heat shrinkage is required the heat treating step can be followed by a "relaxation" step. In the relaxation step heat is applied to the fiber or yarn at a reduced line tension. The lower line tension and hence the relaxation are accomplished by running the rollers of take up unit at a slower speed than those of the feed unit. Suitable exemplary parameters for the relaxation step are an applied temperature of 200° C. with a draw ratio of from 0.8 to 1 to 0.95 to 1. The resulting relaxed PET fibers or yarn exhibit reduced heat shrinkage with some loss of stiffness but the dimensional stability which is a balance of these two properties can be improved.

EXAMPLES

Before discussing the particular examples of the PET yarn processed in accordance with the present invention a discussion of the terms used in the measurement of the physical properties of the yarn is appropriate:

Birefringence: Birefringence, or "Bi" is determined by using a Berek compensator mounted in a polarizing light microscope, which expresses the difference in the light index parallel and perpendicular to the fiber axis. The birefringence level achieved is directly proportional to stress exerted on the fiber material during melt spinning. When PET is spun under relatively low stress conditions, as when spun at low speeds (1–500 mpm) birefringences of 0.001 to 0.002 result. When spun under conditions of high stress, as when spun at high take-up speeds, higher birefringences (0.003 to 0.030) result.

Tensile Properties: Stress-strain curves for five samples of each yarn were measured on an Instron Universal Tester in accordance with ASTM D885-79, vol. 03.01. Tensile strength at break, elongation at break, and initial modulus properties were derived. Tenacity and initial modulus are reported in units of grams per denier at 25 deg. C. Elongation given as percent measured at 25 deg. C.

Elongation at Specified Load (EASL): EASL is the elongation that a yarn sample undergoes when subjected to a load (the specified load). The load specified here is 2 g/den. The EASL values reported here are therefore the elongation at 25 deg. C. that a yarn exhibits when subjected to a load amounting to 2 g/den, expressed as a percent of the original length. EASL is an alternative to initial modulus as a measure of fiber stiffness. Stiffer fibers elongate less under load. Whereas initial modulus reflects the stiffness of the yarn at low applied loads where the stress/strain response is linear, EASL is used as a measure of stiffness at higher loads where the stress/strain response may or may not be linear.

Hot Air Shrinkage(HAS): HAS is the reduction in length, measured at room temperature, that yarn exhibits when exposed to hot air in an oven at 177 deg. C. for 30 min under a load of 0.1 g/den.; expressed as a percent of its original length.

In general, as PET fiber becomes more oriented through spinning or drawing the polymer chains in the fiber become more extended and aligned with the fiber axis. As a result the fiber stiffness increases (initial modulus increases, EASL decreases) and the tendency to shrink in hot air increases (HAS increases). In applications such as tire reinforcement the reinforcing tire cord experiences high tire fabrication temperatures. A tire cord with a high stiffness may loose this stiffness if it shrinks during fabrication. Thus, in the case of tire reinforcement, high stiffness is only useful if it is not accompanied by high shrinkage. In HMLS yarns a relatively high stiffness is achieved without proportionate increase in hot air shrinkage. This is the result of the formation of a distribution of fine crystallites in the fibers of the yarn that effectively restrain shrinkage. EASL and HAS values are frequently taken as measures of yarn stiffness and shrinkage.

Dimensional Stability Rating (DSR): The DSR is a calculated figure of merit that is a measure of yarn dimensional stability. EASL and HAS values are used as measures of stiffness and shrinkage. The DSR is obtained by calculating the ratio of the sum of EASL and HAS for a sample yarn to the sum for a reference yarn $$DSR=(EASL+HAS)^{reference} * 100/(EASL+HAS)^{sample}$$

By this definition, a dimensional stability rating of greater than 100 indicates that the yarn in question (the sample) has a greater stability than the reference and is therefore more desirable as a tire reinforcement.

PET fiber was processed through the various steps of the present process and its physical properties were measured after each step so as to determine what properties were affected by the process steps. The physical properties of the yarns produced by the process steps of the present invention are summarized in Table 1 to follow. Table 1 also includes the properties of commercially available Hoechst Celanese Trevira (R) D-792 HMLS tire yarns both as spun and drawn ("D-792 Spun & Drawn" and after standard heat treating steps ("D-792 Heat Treated").

TABLE 1

| Yarn | Draw | Ten | Elong @ | Init. | EASL | HAS | EASL | DSR |
|---|---|---|---|---|---|---|---|---|
| s/fc - "as drawn" | 6.1 | 6.8 | 10.4 | 141 | 1.19 | 20.9 | 22.1 | 29% |
| s/fc - annealed | 7.4 | 9.8 | 6.5 | 173 | 0.73 | 9.4 | 10.2 | 63% |
| s/fc - annealed/relaxed | 6.5 | 5.5 | 13.4 | 129 | 1.31 | 2.0 | 3.3 | 193% |
| D-792 spun & drawn | | 7.9 | 10 | 111 | 2.3 | 6.4 | 8.7 | 74% |
| D-792 Heat Treated | | 8.9 | 9 | 127 | 1.7 | 4.7 | 6.4 | 100% |

Ten @ Brk = Tenacity at breakage in grams per denier
Elong @ Break = Elongation at breakage in grams per denier
Init Mod = Initial Modulus (Stiffness) in grams per denier
EASL = Elongation at a Specified Load (2 grams per denier) as a percentage
HAS = Hot Air Shrinkage at 177° C. as a percentage
EASL + HAS = Sum of EASL and HAS percentages
DSR = Dimensional Stability Rating: [EASL + HAS]Sample/[EASL + HAS]D-792 as a %

The feed yarn used herein was a 19 filament, 677 denier, PET yarn melt spun from PET resin (iv in OCP=0.68 dL/g) spun at 300° C. at 200 mpm. The fiber had a low birefringence (Bi=0.001) and no indications of heterogeneity or anisotropy. The Tg of the PET fiber was measured by differential scanning calorimetry (DSC) to be=~80° C. Three packages of the yarn were combined to form a 57 filament, 2030 denier yarn.

The feed yarn was drawn in a manner to produce a s/fc microstructure. The 57 filament feed yarn was drawn on the unit of FIG. 1; a head and shoulders neck was initiated by hot air (100° C.) flowing through oven 20 with a load on the line of 650 g. The neck localized at a position 2 to 4" before (upstream) from the oven. At this load the fiber stretched such that the take-up roll ran 6 times faster than the feed roll for a calculated draw ratio of 6.0:1. The ratio of feed to product denier was 6.1, indicating an actual draw ratio of 6.1:1. When a higher load was applied to achieve a higher draw ratio, the line would break. Because the load produced a very high draw ratio in a single step a s/fc microstructure developed in each of the fibers of the yarn that is observable via optical microscopy.

The physical properties of the "as drawn" s/fc yarn are shown in Table 1 in the row "s/fc nontreated". It can be seen that the "as drawn" s/fc yarn has a higher stiffness than the standard tire yarn ("D-792 Heat Treated") with about equal tenacity and elongation. This higher stiffness is indicated by both measures of stiffness: a) by higher initial modulus, and b) by lower EASL. However, the heat shrinkage (HAS) is greater for the "as drawn" s/fc yarn than for the standard D-792 yarn which results in a poor Dimensional Stability Rating of 29%. This indicates that the "as drawn" s/fc yarn is not as dimensionally stable as either as untreated D-792 (DSR=63%) or heat treated D-792 (DSR=100%). Nevertheless if heat shrinkage is not a consideration in the application for which the yarn is intended, the physical properties of the s/fc, non-treated PET yarn are superior to that of D-792.

In order to improve the dimensional stability rating of the "as drawn" s/fc yarn, it was annealed. The "as drawn" s/fc yarn was subjected to 200° C. heat treatment (annealing) for a residence time of 30 seconds while being drawn at a draw ratio of 1.265 to 1 with an applied load of 920 grams. As is seen in the row "s/fc Annealed" of Table 1 the annealing step has greatly reduced the heat shrinkage while improving modulus and tenacity thus raising the DSR from 29% to 63% which is comparable to that of non heat treated D-792. The s/fc microstructure is preserved in yarns that have been annealed.

In order to further reduce the heat shrinkage the annealed s/fc PET yarn was further processed in a relaxation step. The annealed yarn was heat treated at 200° C. for a residence time of 30 seconds but with a draw ratio of less than one, e.g., the take up unit rotates at a lower speed than the feed unit. In this case the relaxation ratio was 0.95 to 1 at a relatively low line tension of 45 grams. The relaxation step will cause the more shrink prone components in the annealed yarn to contract (relax) while retaining s/fc microstructure. As is shown in the row"s/fc-annealed/relaxed" of Table 1, the resulting PET yarn exhibited lower heat shrinkage (HAS) while retaining a substantial fraction of the stiffness it had after annealing. This results in a DSR of 193%, a substantial improvement in dimensional stability compared to D-792. The combination of low heat shrinkage and high stiffness is not found in the commercially available D-792 PET yarn which when heat treated has a DSR of 100%. Additional relaxation steps may be undertaken to further reduce heat shrinkage.

In order to determine whether the s/fc microstructure is formed in PET copolymers, a yarn comprising 90% by weight PET with a 10% by weight of a 2,6 naphthalene dioate monomer was used as the feed yarn. This yarn was spun at 200 mpm and had a low birefringence. A 57 filament yarn was processed on the equipment of FIG. 1. A s/fc microstructure was formed in certain of the fibers when the yarn was fed at 4 mpm and necking was initiated by heating to 120° C. with a load of 620 grams and a draw ratio of 6.6 to 1. A s/fc microstructure was also formed in certain of the fibers when the yarn was fed at 6 mpm and necking was initiated by heating to 120° C. with a load of 620 grams and a draw ratio of 6.75 to 1. Thus the present process is applicable to copolymers having at least 90% of the components of PET.

The invention has been described with respect to preferred embodiments. However, as those skilled in the art will recognize, modifications and variations in the specific details which have been described and illustrated may be resorted to without departing from the spirit and scope of the invention as defined in the appended claims.

What is claimed is:

1. A process for producing high modulus, high tenacity fibers of polyethylene terephthalate and polyethylene terephthalate copolymers, comprising the steps of:

a) providing a fiber containing at least 90% by weight of unoriented non crystalline polyethylene terephthalate; and b) drawing the fiber containing at least 90% by weight of unoriented non crystalline polyethylene terephthalate so that a head and shoulders neck is initiated and maintained in the fiber at a draw ratio of greater than 5.7 to 1 to impart a sheath/micro fibrillar core morphology to the fiber.

2. The process as claimed in claim 1, further including the step of initiating the head and shoulders neck by means of heating the fiber.

3. The process as claimed in claim 2, wherein the head and shoulders neck is initiated by heating the fiber to a temperature from 60° C. to 120° C.

4. The process as claimed in claim 1, wherein the fiber comprises 100% by weight of polyethylene terephthalate.

5. The process as claimed in claim 1 wherein the fiber contains up to 10% by weight of polyethylene naphthalate.

6. The process as claimed in claim 1, further including the step of further of heat treating the fiber under high line tensions to prevent relaxation at a temperature above the cold crystallization temperature of polyethylene terephthalate but below the melting temperature of polyethylene terephthalate so as to anneal the fiber, reduce heat shrinkage of the fiber, and increase its dimensional stability rating.

7. The process as claimed in claim 6, wherein the annealing step is conducted at a line tension high enough to produce draw ratios of from 1.05 to 1.3 to 1.

8. The process as claimed in claim 1, further including the step of relaxing wherein the fiber is heated at a temperature above the cold crystallization temperature of polyethylene terephthalate but lower than the melting temperature of polyethylene terephthalate under reduced line tension for a draw ratio of less than 1 to 1.

9. The process as claimed in claim 8, wherein the relaxation step takes place at draw ratios of from 0.8 to 0.95 to 1.

10. A high modulus high tenacity fiber of polyethylene terephthalate and polyethylene terephthalate copolymers having a microstructure consisting of a core having a multitude of crystalline microfibrils surrounded by an oriented, partially crystalline sheath but having no filaments as are present in the core, said fiber being produced by taking a fiber of at least 90% by weight of non oriented and non crystalline polyethylene terephthalate and drawing said fiber to a draw ratio of greater than 5.7 to 1 in one step, so that a head and shoulders neck is formed and maintained in the fiber, and a sheathmilamentous core is generated.

11. The fiber as claimed in claim 10 wherein the head and shoulders neck is initiated by the heating of the fiber.

12. The fiber as claimed in claim 11, wherein the head and shoulders neck is initiated by heating the fiber to a temperature from 60° C. to 120° C.

13. The fiber as claimed in claim 10 wherein the fiber contains substantially 100% polyethylene terephthalate.

14. The fiber as claimed in claim 10 wherein the fiber contains up to 10% by weight of the components of polyethylene naphthalate.

15. The fiber as claimed in claim 10 having increased stiffness, reduced heat shrinkage, and higher dimensional stability rating by means of annealing the fiber at a temperature above the cold crystallization temperature of polyethylene terephthalate at high line tensions to prevent relaxation and contraction of any element in the microstructure, so as to heat treat the fiber.

16. The fiber as claimed in claim 15, wherein the annealing is conducted at line tensions that produce a small addition draw (draw ratios of from 1.05 to 1.3 to 1).

17. The fiber as claimed in claim 15 having further reduced heat shrinkage and increased dimensional stability by means of relaxing the drawn and heat treated fiber at a temperature above the cold crystallization temperature of polyethylene terephthalate at reduced line tensions that allow elements in the fiber to contract.

18. The fiber as claimed in claim 17, wherein the relaxation takes place at line tensions such that the draw ratio during relaxation is (from 0.8 to 0.95 to 1) indicates a contraction.

* * * * *

UNITED STATES PATENT AND TRADEMARK OFFICE

CERTIFICATE OF CORRECTION

PATENT NO. : 5,935,499

DATED : Aug. 10, 1999

INVENTOR(S) : O. Richard Hughes

It is certified that error appears in the above-identified patent and that said Letters Patent is hereby corrected as shown below:

On the title page, item [54] Title, " METHOD AND APPARATUS OF TRANSFERRING A PACKET AND GENERATING AN ERROR DETECTION CODE THEREFORE" should be deleted, and substitute by inserting the following, --FORMATION OF PET YARNS HAVING A SHEATH/FIBRILLAR CORE MICROSTRUCTURE--.

Signed and Sealed this

Sixteenth Day of May, 2000

*Attest:*

*Attesting Officer*

Q. TODD DICKINSON

*Director of Patents and Trademarks*